United States Patent [19]

Blackburn

[11] Patent Number: 4,523,535

[45] Date of Patent: Jun. 18, 1985

[54] STITCH CHAIN CUTTER FOR SEWING MACHINES

[76] Inventor: James Blackburn, Rte. 1, Box 476, Boomer, N.C. 28606

[21] Appl. No.: 635,811

[22] Filed: Jul. 30, 1984

[51] Int. Cl.[3] ..... D05B 65/02; D05B 65/06

[52] U.S. Cl. ..... 112/288; 112/130

[58] Field of Search ..... 112/288, 287, 130, DIG. 1–DIG. 3

[56] References Cited

U.S. PATENT DOCUMENTS

| | | | |
|---|---|---|---|
| 2,318,843 | 5/1943 | Enos | 112/288 |
| 2,999,473 | 9/1961 | Wanner | 112/288 |
| 3,149,594 | 9/1964 | Buckneus et al. | 112/288 X |
| 3,303,805 | 2/1967 | Steiner | 112/288 |
| 3,557,730 | 1/1971 | Armstead, Jr. | 112/288 X |

*Primary Examiner*—Werner H. Schroeder
*Assistant Examiner*—Andrew M. Falik
*Attorney, Agent, or Firm*—Bell, Seltzer, Park & Gibson

[57] ABSTRACT

A stitch chain cutting device includes a fixed blade disposed in a horizontal plane and adjacent the suction inlet of a suction housing downstream of the needle and the feed dog of a sewing machine. A movable knife blade is supported for cooperation with the fixed knife blade and the movable knife blade is adjustably biased into cutting engagement with the fixed knife blade to thereby adjust the amount of pressure contact of the movable blade against the fixed blade. A cam is supported on the feed dog and engages and moves the movable knife blade in a cutting movement relative to the fixed knife blade with each reciprocation of the feed dog. The cam is supported for adjustment on the feed dog so as to vary the position of the cutting movement of the movable knife blade against the fixed knife blade when the knife blades become worn or dull in one cutting position.

7 Claims, 5 Drawing Figures

STITCH CHAIN CUTTER FOR SEWING MACHINES

FIELD OF THE INVENTION

This invention relates generally to a stitch chain cutter for sewing machines and more particularly to such a cutter for severing the thread between successive workpieces by means of a suction tube which is positioned adjacent a pair of cutting blades with one of the cutting blades being driven by the feed dog of the sewing machine.

BACKGROUND OF THE INVENTION

Stitch chain cutters for sewing machines are well known in the art. Typical of the numerous patents which illustrate various types of stitch chain cutters are U.S. Pat. Nos. 3,143,987; 3,541,984; 3,624,734; 3,749,040; and 4,332,209. These patents all utilize suction for withdrawing the thread after it is cut and include one movable cutter blade which moves in a cutting operation against a fixed cutting blade. The movable cutting blade is adjusted with a relatively high-contact pressure against the fixed cutting blade and this high-contact pressure results in rapid wear and dulling of the blades.

U.S. Pat. No. 3,149,594 discloses a stitch chain cutter including a movable blade which is operated by a linkage connected to the feed dog and U.S. Pat. No. 3,242,892 discloses a cutter blade which is carried by the feed dog. However, the movable cutter blades illustrated in these two patents are not provided with means to adjust the cutting position and the contact pressure between the movable and fixed blades, and as a result, the cutting blades are subject to rapid wear and dulling.

SUMMARY OF THE INVENTION

With the foregoing in mind, it is an object of the present invention to provide a stitch chain cutter in which the movable cutting blade is adjustably biased against the fixed cutting blade to provide the proper amount of contact pressure to ensure proper cutting of the stitch chain and to prevent rapid wear of the blades. Operation of the movable blade by the feed dog also includes means for adjustment of the cutting position of the movable blade relative to the fixed blade so as to increase wear life of the cutter.

The stitch chain cutter of the present invention includes a knife blade fixed on the suction tube and in a horizontal plane adjacent the suction inlet and downstream of the needle and feed dog. A movable knife blade is disposed in a horizontal plane and includes a sharpened first end cooperating with the fixed knife blade. The medial portion of the movable knife blade is pivotally supported and provided with spring means for resiliently urging the movable knife blade away from the fixed knife blade. A cam plate is supported on the feed dog for engaging the outer free end of the movable knife blade and moving the same in a cutting movement relative to the fixed knife blade with each reciprocation of the feed dog. Adjustable biasing means is supported in the free end of the movable knife blade and is operable for biasing the sharpened end portion of the movable knife blade into cutting engagement with the fixed knife blade.

Both the fixed knife blade and the movable knife blade are supported on the suction tube or housing which is removably connected to and supported on the sewing machine for quick and easy removal in the event the stitch chain cutter needs repair or replacement.

It is preferred that the cutting edge of the movable knife blade be provided with a carbide insert for further increasing the wear life of the movable cutting blade. The fixed knife blade extends downwardly at a slight angle relative to the movable cutting blade to ensure proper cutting relationship with the reciprocating movable knife blade.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

The stitch chain cutter of the present invention is disclosed in association with an overedge sewing machine of the type manufactured and sold by Union Special. This type of sewing machine is well known in the art, and therefore, only the portions of the machine are illustrated which are necessary to an understanding of the present invention. The details of this type of sewing machine are illustrated and described in detail in the Wallenberg et al U.S. Pat. No. 2,704,042. However, it is to be understood that the present stitch chain cutter may also be applied to various other types of sewing machines.

Figure 1:
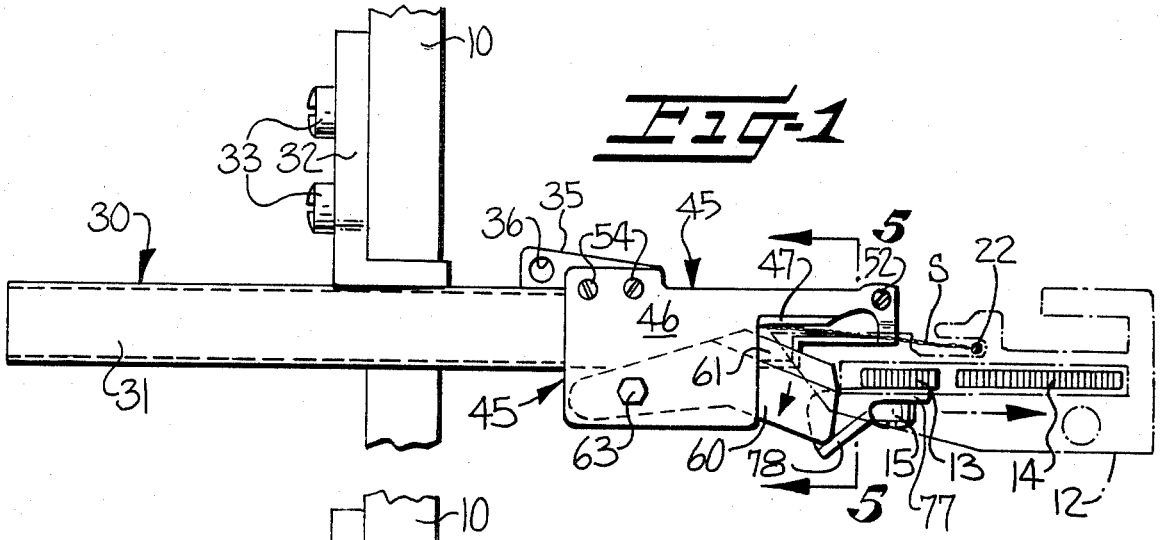
FIG. 1 is a fragmentary plan view of the stitch chain cutter and illustrating its positional relationship to the conventional parts of the sewing machine and with the movable cutter blade spring biased to an open position.
Figure 2:
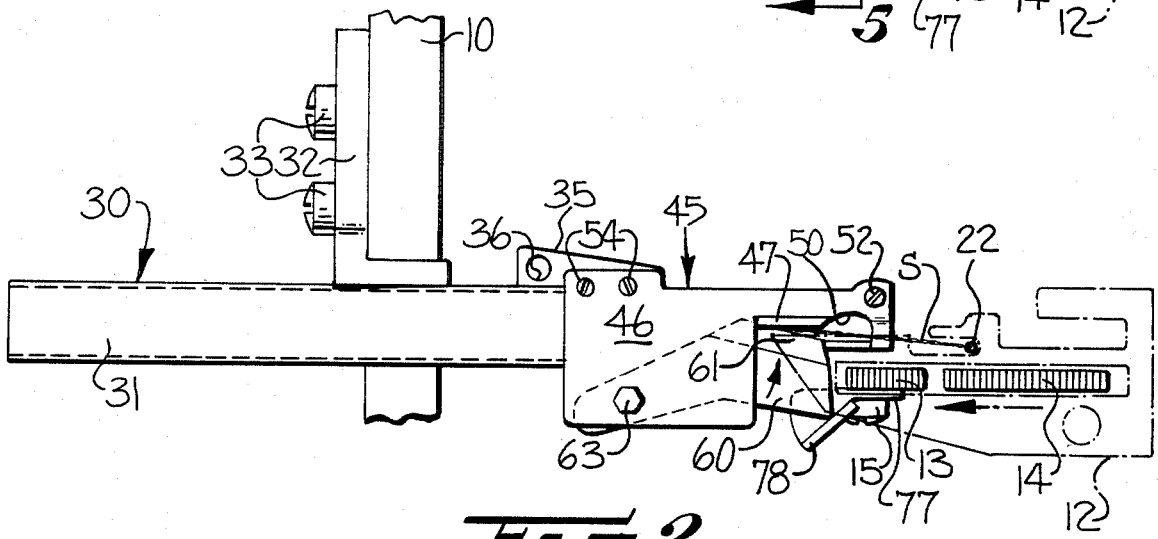
FIG. 2 is a view similar to FIG. 1 but showing the inward movement of the movable knife blade when engaged by the cam plate on the feed dog.

The sewing machine includes a cast frame 10 (FIGS. 1–3) having a cloth plate 11 supported thereon and including downwardly extending apron portions which normally cover and conceal the conventional stitch-forming and work-feeding devices. The cloth plate 11 is pivotally mounted on the frame 10 and may be swung outwardly to expose the parts positioned therebeneath, including the stitch chain cutter of the present invention. A throat plate 12, shown in dash-dot lines in FIGS. 1 and 2, is suitably supported on the machine with its upper surface flush with the upper surface of the cloth plate 11.

The throat plate 12 is provided with elongate slots for operation of a main feed dog 13 and a differential feed dog 14 which cooperate with a presser foot, not shown, for advancing the fabric forward in relation to the stitch-forming mechanism. The main feed dog 13 is secured by a screw 15 to the forward end of a feed bar 16 (FIG. 3) which is forked at its rear end for slidable engagement with a block 17 pivotally supported upon a stud 18. The forward end portion of the feed bar 16 is provided with a downwardly extending portion which is operated by an eccentric on the main shaft of the machine, not shown, to impart a continuous orbital movement to the feed dog 13 in repeated forward and rearward and rising and falling strokes. The differential feed dog 14 is similarly attached by a screw 20 to the forward end of a feed bar 21 also mounted for rocking and sliding movement in the same manner as the feed bar 16 by means of eccentrics mounted on the main shaft, not shown. A curved needle 22 (FIG. 3) is supported at its upper end in the outer end of an operating arm 23 which is in turn secured to the needle rock shaft, not shown, of the sewing machine. An overedge looper 25 is supported on the end of a looper shaft 26 and cooperates with the needle 22 and an under looper, not shown, for forming an overedge seam along the edge of the fabric workpieces passed through the sewing machine.

Figure 3:
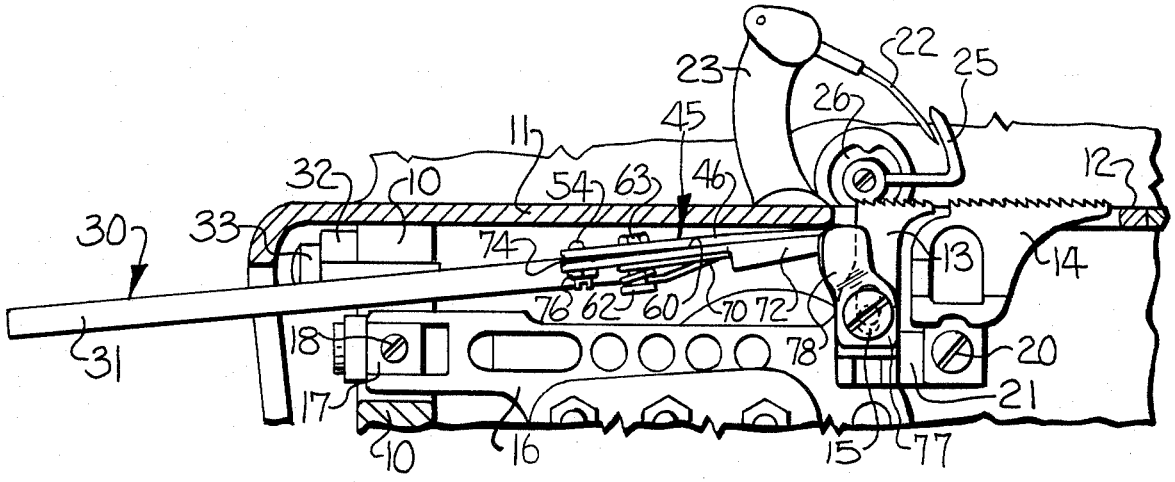
FIG. 3 is a vertical sectional view through a portion of the sewing machine and illustrating the relative position of the stitch chain cutter to the conventional parts of the sewing machine.

The stitch chain cutter of the present invention includes a suction housing, broadly indicated at 30, including a rectangular suction tube 31 having its rear outer free end adapted to be connected by a suitable hose or the like to a source of suction, not shown. One leg of an L-shaped support bracket 32 is suitably connected, as by welding, to one side of a medial portion of the rectangular suction tube 31. The other leg of the L-shaped support bracket 32 is fixed to the sewing machine frame 10, as by screws 33. As best illustrated in FIG. 3, the vertical face of the leg of the L-shaped support bracket 32, positioned against the frame 10, is positioned at an angle relative to the upper and lower surfaces of the rectangular suction tube 31 so that the forward end portion of the suction housing 30 is inclined upwardly as it extends inwardly beneath the cloth plate 11.

Figure 4:
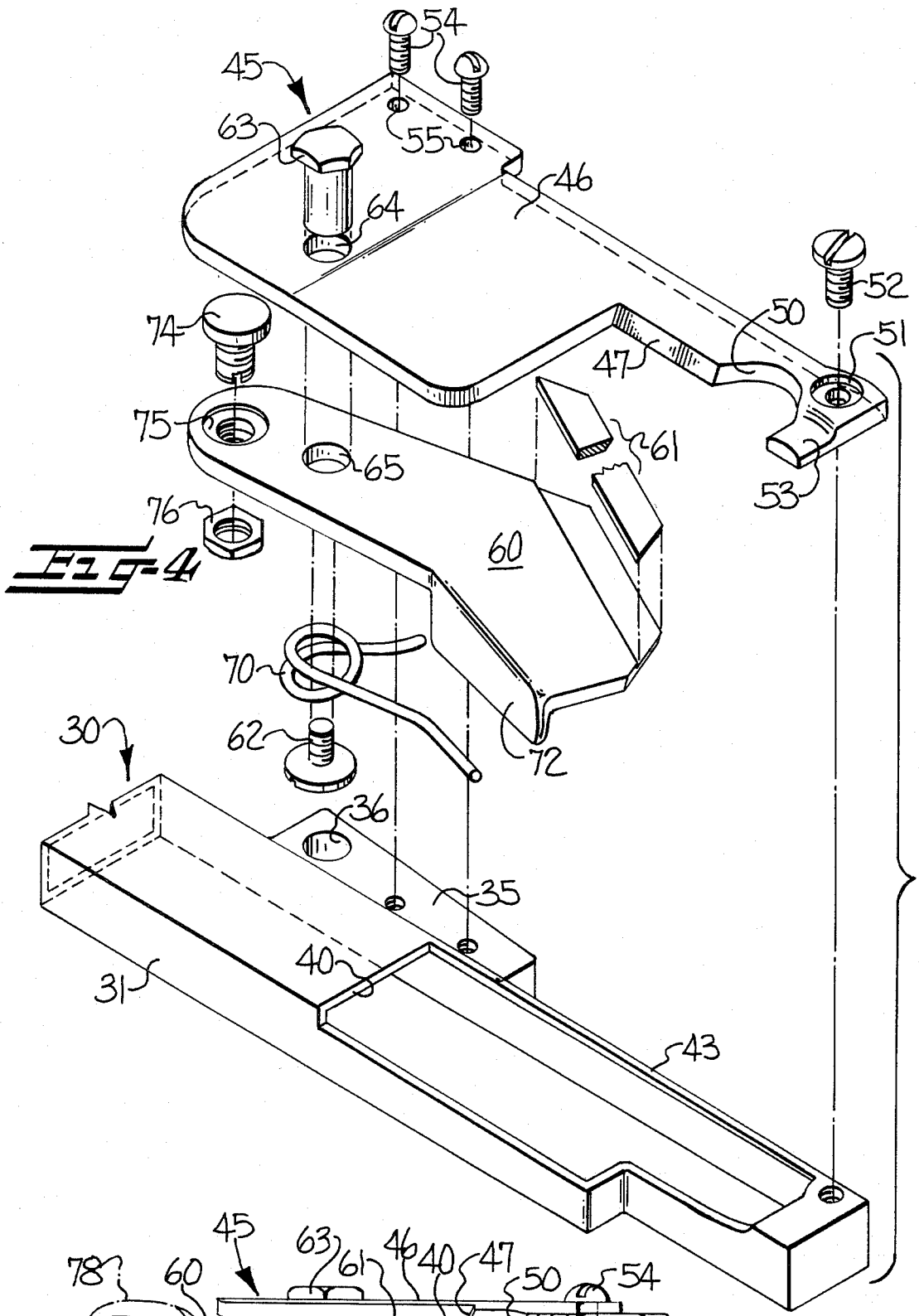
FIG. 4 is an exploded isometric view of the forward end of the stitch chain cutter and illustrating the relationship between the fixed and movable knife blades.
Figure 5:
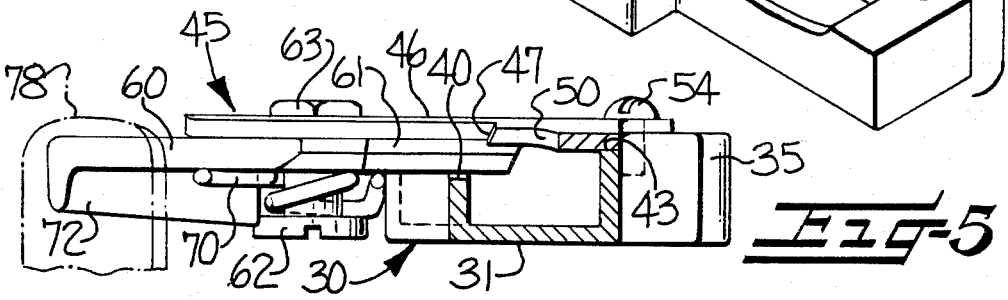
FIG. 5 is an enlarged transverse vertical sectional view taken substantially along the line 5—5 in FIG. 1.

The forward end portion of the rectangular suction tube 31 has one side of an outwardly extending support block 35 secured thereto. The rear portion of the support block 35 is provided with a vertical opening 36 adapted to receive and support the lower end of a vertical rod for supporting a thread guide, not shown. The upper surface of the rectangular suction tube 31 is cut away, as indicated at 40 in FIG. 4, and the forward end is reduced in width. Also, the upper edge of the rear wall is inclined downwardly, as indicated at 43 in FIG. 4, so that the forward portion of the rectangular suction tube 31 is gradually reduced in thickness, for purposes to be presently described.

Fixed knife blade means, broadly indicated at 45, is supported on and covers a substantial portion of the opening in the forward end of the rectangular suction tube 31. The fixed knife blade means 45 includes a horizontally disposed rectangular support plate 46 having a forwardly extending portion of reduced width with one edge being ground at an angle to form a fixed knife blade 47. A curved cutout 50 is formed adjacent the knife blade 47 and provides a suction inlet at the forward end of the fixed blade means 45. The forward end of the fixed knife blade portion of the support plate 46 is provided with a countersunk opening or hole 51 (FIG. 4) for reception of a mounting screw 52 which extends through the hole 51 and is threadably supported in the forward end of the rectangular suction tube 31. A reduced thickness portion 53 of the support plate 46 rests on and covers the forward end of the rectangular suction tube 31. The reduced portion 53 extends beneath the throat plate 12 when the stitch chain cutter is positioned on the sewing machine.

The rear portion of the support plate 46 is fixed on the upper surface of the rectangular suction tube 31 by screws 54 which extend through holes 55 in the plate 46 and are threadably embedded in the support block 35. When the support plate 46 is secured to the upper surface of the rectangular suction tube 31, the screw 52 causes the narrow fixed blade 47 to be inclined downwardly at a slight angle because of the inclined upper surface 43 of the rectangular suction tube 31. This downwardly inclined angle of the fixed cutter blade 47 provides the proper cutting relationship with the lower movable blade, to be presently described.

A movable knife blade 60 is disposed in a horizontal plane and beneath the blade support plate 46 and includes a sharpened forward end portion having a hardened carbide steel insert 61 for cooperating with the fixed knife blade 47. Pivot means is provided for supporting the medial portion of the movable knife blade 60 on the knife support plate 46 and includes a screw 62 and an internally threaded shoulder sleeve 62 which extends through a hole 64 in the plate 46 and through a hole 65 in the blade 60. A combination compression and torsion spring 70 is wound around the threaded sleeve 63 and one end bears against the side of the rectangular suction tube 31 while the other end engages and bears against a downwardly turned cam leg 72 on the forward end portion of the movable cutter blade 60. The spring 70 normally urges the movable cutter blade 60 upwardly against the plate 46 and also in a clockwise direction in FIGS. 1 and 2 so that the movable cutter blade 60 moves outwardly away from the fixed cutter blade 47.

Adjustable biasing means is supported in the free rear end of the movable knife blade 60 and includes a threaded cam stud 74 which is threadably supported in a countersunk threaded hole 75 in the rear portion of the movable knife blade 60. A lock nut 76 is threaded onto the lower end of the cam stud 74 and maintains the same in adjusted position. The upper end of the cam stud 74 is enlarged and rounded for engaging the lower surface of the support plate 46. The vertical position of the cam stud 74 may be adjusted to vary the contact pressure of the sharpened end portion of the movable blade 60 into cutting engagement with the fixed knife blade 47.

Cam means is supported on the feed dog 13 for engaging and moving the movable cutter blade 60 in a cutting movement relative to the fixed knife blade 47 with each rearward reciprocation of the feed dog 13. The cam means is illustrated as being formed of a twisted metal plate 77 with an inclined upper cam end 78. The lower end of the cam plate 77 is provided with an elongate hole for reception of the screw 15 (FIG. 3) to support the cam plate 77 in adjusted position on the feed dog 13. The cam plate 77 is supported for adjustment on the feed dog 13 so that the upper cam end 78 will engage the forward end of the cam leg 72 and move the movable blade 60 inwardly in a cutting action with the fixed blade 47 during each rearward movement of the feed dog 13.

Operation

To install the present stitch chain cutter on the sewing machine, it is merely necessary to drill and tap two holes for reception of the screws 33 to support the L-shaped bracket on the frame 10. The holes in the L-shaped bracket are elongated so that minor adjustments of the position of the stitch chain cutter may be made to accurately position the blades and the suction inlet of the suction housing 30 in the proper position downstream of the needle 22 and feed dogs 13, 14 so that the stitch chain, indicated at S in FIGS. 1 and 2, is drawn inwardly, as illustrated in FIGS. 1 and 2. The cam plate 77 is then installed on the feed dog 13 by removing and replacing the screw 15 and the cam plate 77 is adjusted so that the stitch chain S is cut by cutting reciprocating action of the movable blade 60 at a position near the rear end of the fixed cutting blade 47.

If necessary, the adjustable stud 74 may be rotated to either raise or lower the rear end of the movable blade 60 so that the cutting edge thereof engages the fixed blade 47 with the desired amount of pressure contact to provide efficient cutting but to prevent excess wear of the blades. With the stitch chain cutter properly positioned, operation of the sewing machine causes the inclined cam 78 to engage and move the forward end of the movable cutter blade 60 inwardly in a cutting action against the fixed cutting blade 47 to sever the stitch chain S, and the severed portions of the stitch chain are drawn away and removed by the suction currents in the rectangular suction tube 31.

If the cutting blades become dull in this cutting position, the position of the inclined cam 78 can be adjusted slightly by loosening and tightening the screw 15 so that the movable blade 60 then operates with the fixed blade 47 at a different cutting position to cut the stitch chain S at a position forward of the previous cutting location. After the stitch chain cutter has been used until the blades are dull, or if the stitch chain cutter should need repair, the stitch chain cutter can be quickly and easily removed from the sewing machine and replaced with another stitch chain cutter by simply removing the screws 33 and positioning another stitch chain cutter in the proper position. Also, if the type of thread being used to form the stitch chain is changed, it may be desirable to change the amount of contact pressure of the movable blade 60 against the fixed blade 47 and this can be accomplished by adjusting the vertical position of the adjustable cam stud 74.

Thus, the stitch chain cutter of the present invention includes an adjustable biasing means supported in the free end of the movable knife blade. The adjustable biasing means is operable for biasing the sharpened end portion of the movable knife blade into cutting engagement with the fixed knife blade to thereby vary the amount of contact pressure of the movable knife blade against the fixed knife blade. The cam means for engaging and moving the movable knife blade is supported for adjustment on the feed dog so that the cutting position of the movable knife blade relative to the fixed knife blade may be adjusted when a particular cutting position becomes dull. The present stitch chain cutter is simple in construction and may be easily and quickly applied to conventional types of sewing machines.

In the drawings and specification there has been set forth the best mode presently contemplated for the practice of the present invention, and although specific terms are employed, they are used in a generic and descriptive sense only, and not for purposes of limitation, the scope of the invention being defined in the claims.

That which is claimed is:

1. A stitch chain cutting device for a sewing machine including needle means for forming stitches in fabric and forming a stitch chain between successive pieces of fabric, and feed dog means reciprocating in timed relationship with said needle means for moving the fabric in a horizontal plane and past said needle means, said stitch chain cutting device comprising a. suction housing means including a forward end having a suction inlet positioned downstream of said needle and feed dog means for drawing the stitch chain into said suction inlet, b. fixed knife blade means disposed adjacent said suction inlet and downstream of said needle and feed dog means, said fixed knife blade means being disposed in a horizontal plane and including a horizontal blade support plate fixed on the forward upper surface of the forward end portion of said suction housing means, said fixed knife blade plate further including a portion extending outwardly beyond one side of said suction housing means, c. movable knife blade means disposed in parallel relationship with said fixed knife blade means and including a sharpened first end portion cooperating with said fixed knife blade means, and an opposite free end, d. pivot means supporting the medial portion of said movable knife blade means on said outwardly extending portion of said fixed knife blade plate, e. adjustable biasing means positioned between said free end of said movable knife blade means and said fixed knife blade means and being operable for biasing said sharpened end portion of said movable knife blade means into cutting engagement with said fixed knife blade means, and f. cam means supported on said feed dog means for engaging and moving said movable knife blade means in a cutting movement relative to said fixed knife blade means with each reciprocation of said feed dog means.

2. A stitch chain cutting device according to claim 1 including spring means associated with said pivot means and engageable with said movable knife blade means for resiliently urging said movable knife blade means in a direction away from said fixed knife blade means.

3. A stitch chain cutting device according to claim 2 wherein said adjustable biasing means is supported in said free end of said movable knife blade means.

4. A stitch chain cutting device according to claim 1 wherein said cam means is supported for adjustment on said feed dog means so that the movement of said movable knife blade means relative to said fixed knife blade means may be varied to thereby vary the cutting position of the stitch chain.

5. A stitch chain cutting device according to claim 1 wherein said movable knife blade means is disposed beneath said fixed cutter blade plate, and wherein said adjustable biasing means comprises a cam stud supported for vertical adjustment in said opposite free end of said movable knife blade means and having an upper end in sliding engagement with the lower surface of said fixed knife blade plate.

6. A stitch chain cutting device according to claim 1 wherein the forward end portion of said fixed knife blade means is inclined downwardly relative to said movable knife blade means to enhance the cutting operation.

7. A stitch chain cutting device for a sewing machine including needle means for forming stitches in fabric and forming a stitch chain between successive pieces of fabric, and feed dog means reciprocating in timed relationship with said needle means for moving the fabric in a horizontal plane and past said needle means, said stitch chain cutting device comprising a. suction housing means including a forward end having a suction inlet positioned downstream of said needle and feed dog means for drawing the stitch chain into said suction inlet, b. fixed knife blade means disposed in a horizontal plane adjacent said suction inlet and downstream of said needle and feed dog means, c. movable knife blade means disposed in a horizontal plane and including a sharpened first end portion cooperating with said fixed knife blade means, and an opposite free end, d. pivot means supporting the medial portion of said movable knife blade means on said fixed knife means, e. adjustable biasing means supported in said free end of said movable knife blade means and being operable for biasing said sharpened end portion of said movable knife blade means into cutting engagement with said fixed knife blade means, said adjustable biasing means comprising a cam stud supported for vertical adjustment in said opposite free end of said movable knife blade means and having an upper end in sliding engagement with the lower surface of said fixed knife blade means, and f. cam means supported on said feed dog means for engaging and moving said movable knife blade means in a cutting movement relative to said fixed knife blade means with each reciprocation of said feed dog means, and wherein said cam means is supported for adjustment on said feed dog means so that the movement of said movable knife blade means relative to said fixed knife blade means may be varied to thereby vary the cutting position of the stitch chain.

* * * * *